US005089301A

United States Patent [19]

Kistrup et al.

[11] Patent Number: 5,089,301

[45] Date of Patent: Feb. 18, 1992

[54] SOLUTION FOR THE ACTIVATING OF ELECTRICALLY NONCONDUCTIVE SUBSTRATE SURFACES AND METHOD OF PREPARING THE SAID SOLUTION

[75] Inventors: Holger Kistrup, Esslingen; Otwin Imhof, Nürtingen, both of Fed. Rep. of Germany

[73] Assignee: Mercedes-Benz AG, Fed. Rep. of Germany

[21] Appl. No.: 456,965

[22] Filed: Dec. 26, 1989

[30] Foreign Application Priority Data

Dec. 24, 1988 [DE] Fed. Rep. of Germany ..... 3843903

[51] Int. Cl.[5] ..... C23C 26/00

[52] U.S. Cl. ..... 427/304; 427/306; 106/1.11

[58] Field of Search ..... 427/304, 306; 106/1.11

[56] References Cited

U.S. PATENT DOCUMENTS

| | | | |
|---|---|---|---|
| 3,672,938 | 6/1972 | Zeblisky | 427/304 |
| 3,682,671 | 8/1972 | Zeblisky | 106/1.26 |
| 3,960,573 | 6/1976 | Zeblisky | 106/1.26 |
| 3,967,010 | 6/1976 | Maekawa | 427/306 |
| 4,002,779 | 1/1977 | Nischwitz | 427/304 |
| 4,084,023 | 4/1978 | Dafter | 427/304 |
| 4,187,198 | 2/1980 | Zeblisky | 106/1.11 |
| 4,201,825 | 5/1980 | Ebneth | 427/304 |
| 4,212,768 | 7/1980 | Jameson | 427/304 |
| 4,645,573 | 2/1987 | Orban | 427/306 |
| 4,835,015 | 5/1989 | Kistrup | 427/306 |
| 4,863,758 | 9/1989 | Rhodenizer | 427/304 |

FOREIGN PATENT DOCUMENTS

| | | | |
|---|---|---|---|
| 2756333 | 6/1979 | Fed. Rep. of Germany | 427/304 |
| 3631055 | 5/1987 | Fed. Rep. of Germany | 427/304 |
| 3637130 | 9/1987 | Fed. Rep. of Germany | 427/304 |
| 942850 | 11/1963 | United Kingdom . | |
| 2196651 | 5/1988 | United Kingdom | 427/304 |

OTHER PUBLICATIONS

S. John et al., "Practical Formulations for Plating on ABS Plastics", Metal Finishing, Mar. 1986, pp. 51-54.

*Primary Examiner*—Michael Lusignan
*Assistant Examiner*—Vi Duong Dang
*Attorney, Agent, or Firm*—Evenson, Wands, Edwards, Lenahan & McKeown

[57] ABSTRACT

An activation solution for the activating of electrically nonconductive plastic surfaces of the purpose of a subsequent chemical metallization is prepared from an acid, a palladium(II) salt and a tin(II) salt, the palladium being present predominately in complexly dissolved form. The solution is prepared at room temperature, the molar ratio of the palladium employed and of the tin employed being about 1:1 to 1:2. The solution is mature and catalytically effective after about 10 minutes. There are no further stabilizing agents, auxiliary materials or the like present.

4 Claims, No Drawings

SOLUTION FOR THE ACTIVATING OF ELECTRICALLY NONCONDUCTIVE SUBSTRATE SURFACES AND METHOD OF PREPARING THE SAID SOLUTION

BACKGROUND AND SUMMARY OF INVENTION

The present invention generally relates to an activation solution for activating electrically nonconductive substrate surfaces of plastic materials for the purpose of a subsequent chemical metallization of the activated substrate surfaces, and more particularly to such an activation solution containing an acid, a palladium (II) compound and a tin(II) compound, the palladium being present predominantly in complexly dissolved form, and a method of preparing the solution.

In order to impart electric conductivity to substrate surfaces which are made of electrically nonconductive sythetic fibers, the substrate surfaces must first be activated chemically. Once activated, a chemical metallization of the activated surface then takes place as the next process step. During the course of the initially performed activation step, the deposition of a catalytically active layer, containing virtually nothing but precious metals, on the fiber surface takes place.

During the subsequent chemical metallization, the fiber or else fibril surface thus activated is brought into contact with a chemical metallization solution Metal ions form the metallization solution are deposited as metal by a chemical reduction agent contained in the metallization solution at the points of the fiber surface where the catalyst particles, previously absorbed during the activation process, are located. The latter coat themselves with the deposited metal, which then for its part, in statu nascendi, catalytically promotes further metal deposition, so that the fiber surface is covered with a thin, firmly adhering metal skin once metallization has been completed.

Depending on the technical application interest, the metallized surface of the fibers, for example of a nonwoven material or of a needle felt, can then be reinforced further with a metal by galvanic means, the galvanic deposition of a plurality of metals one after the other or of metal alloys also being possible. In this way, it is possible to coat electrically nonconductive fibers of a nonwoven material or needle felt with a metallic layer by the specified chemical metallization process, the thickness of the metal coat as well as its composition being variable depending on the intended application case.

As already mentioned above, the activation solutions usually contain precious metals, because the deposition of precious metals or compounds containing precious metals on the plastic surfaces acts as an excellent catalyst for the subsequent chemical metal deposition. Various precious metals have already been used as catalytically active substances in elementary form or else in the form of compounds, such as for instance silver, gold or platinum; but for the present invention only such activation solutions which have been prepared on the basis of palladium/tin and which without doubt play a predominant role in the plastic surface activation come into consideration.

In this case, a distinction has to be drawn between two step activations, i.e. the substrate is contacted successively with tin(II) salt solutions and palladium(II) salt solutions in this or the reverse order, and one-step activation. In the case of the latter, only one activation solution, which already contains the palladium in catalytically active form and, in addition, also contains excess tin, is brought into contact with the substrate surface.

The present invention relates to the one-step activation process based on the palladium/tin activation solution. Here too, a distinction is drawn by the technical literature between two types of activation solutions, namely those which contain the catalytically effective palladium in colloidally dissolved form, along with the usual excess of tin, and those activations which contain the catalytically active palladium dissolved and bonded to the tin, often, referred to as a complex palladium/tin solution. Common to both types of palladium/tin activation solutions is that one works with an acid solution, often salt-acid.

Thus, in U.S. Pat. No. 3,001,920, a reusable activation solution with colloidally dissolved palladium is employed, the palladium chloride being stabilized by a tin-containing protective colloid. This specification also discloses that a high excess of acid and tin has a stabilizing effect on the palladium colloid. In the examples of this citation, the molar ratio of palladium to tin is 1:37 to at least 1:5. Colloidal activation solutions, which are laborious in preparation, requiring heating and long stirring, and complicated in their production by requiring the mixing in of a Lewis Base, are also specified in U.S. Pat. No. 3,767,583.

U.S. Pat. No. 3,902,908 describes a palladium-containing activation solution which contains a soluble palladium/tin complex. This complex requires a stoichiometric excess of tin, a laborious preparation (heating to 75° C.) and the admixture of a neutral, that is to say not directly involved in the reaction, additive, which forms voluminous precipitates in the subsequent maturing operation required.

Similarly elaborate procedures such as heating, admixture of stabilizers, observance of certain waiting times from one hour to several days are also specified in other literature references which deal with the employment of complex palladium/tin activation solutions. For instance, U.S. Pat. No. 4,187,198 describes a complex, optically clear, palladium/tin activation solution. After the mixing together of the palladium and tin solution, the activation solution must first mature for at leas one hour at room temperature or, in a ratio of palladium/tin/anion of at least 1:1:3, be heated to about 80° C. in order to be usable only after a stabilizer has been added. Elsewhere in this specification, the minimum necessary ratio of palladium/tin/anion is specified 1:6:42, with the mentioned admixture of a stabilizer.

In U.S. Pat. No. 3,682,671, a soluble palladium/tin complex with a molar ratio of palladium/tin/anion of 1:1:3 to 1:6:24 is specified, although without specifying which minimum ratio of palladium chloride and tin chloride employed is to be observed in order that, according to its stability constant, the complex can form. However, after bringing together the palladium ions and ions, the solution must set for an hour at 24° C., in order that the palladium/tin complex described forms, or kept at 80° C., maintaining a concentration of palladium chloride of at least 2.5 g/l.

Further complex palladium/tin activation solutions, for instance in U.S. Pat. No. 3,960,573, again require a maturing time of one hour at 25° C., a heating operation or the addition of stabilizers.

Further, in U.S. Pat. Noo. 3,672,938, a soluble palladium/tin complex, for the activation of correspondingly prepared substrate surfaces, is described with the composition of palladium/tin/anion between 1:1:3 and 1:3:19. The specification states that a molar ratio of employed palladium/tin/chloride of 6:42 is necessary for this.

In view of the foregoing, it may thus be remarked with regard to the prior art that complex palladium/tin activation solutions operate in their preparation with a high tin excess in comparison with the palladium employed (in a molar ratio of at least 3:1 or more),a nd require considerable maturing times of an hour and more, or stabilizing additives (often Lewis bases) have to be added to the complex formed. This prior art may by all means be referred to as satisfactory, as long as a prolonged shelf-life of the complex palladium/tin activation solution is needed in order for it to be able to be used again and again for as many substrate parts to be activated as possible. The laborious type of preparation of the complex activation solution and also the high price of the palladium employed, then of course, also justify any cleaning procedure of the nonconductive substrate surface which may be involved, as repeatedly described in the cited literature as a prerequisite for activation On the other hand, the qualification features of a complex palladium/tin activating solution are to be assessed quite differently if shelf-life and reusability of the complex palladium/tin activation solution no longer count among the predominant factors for reasons of the special surface condition of the substrate. Thus, the subject of the present invention is to relate with preference to such cases where shelf-life and reusability of the solution are not major considerations. In the activation of fiber surfaces of nonwoven materials or needle felts of nonconductive plastic, for example, it is not necessary to have, in every case, a stabilized activation solution available (stabilized by an addition of flocculation inhibitors), obtained by a laborious preparation method.

The invention is therefore based on an object of creating an activation solution on the basis of complexly dissolved palladium/tin which can be prepared quickly and simply and which, in the interests of an easier disposal of the used activation solution, is loaded with as few pollutants requiring disposal as possible. Such an activation solution can be employed above all in the activation of fiber surfaces of nonwoven materials, needle felts or else open-pored foams which can, by virtue of their production, be wetted by aqueous solutions and after the activation are subsequently to be chemically metallized.

In practice, this involves a solution being made up at room temperature from hydrochloric acid (for example 70 ml of concentrated HCl, 37%, per liter), palladium-(II) chloride and tin(II) chloride (if appropriate as dehydrate) and water. An essential requirement here is that the molar ratio, of palladium to tin, lies approximately between about 1:1 and 1:2. Within 10 minutes of the addition of the tin, the solution is mature and satisfactorily catalytically effective, which is outwardly recognizable by the appearance of a brown color. Instead of palladium(II) chloride and tin(II) chloride, of course other salts may also be employed.

On account of a small tin excess in relation to the palladium present in the solution, a shelf-life of the thus freshly prepared activation solution, after the short maturing time, is, of course, less than the shelf-life otherwise usual complex palladium/tin activation solutions. However, it has been found that the shelf-life of the activation solution according to the present invention is adequate for the activation of synthetic fibers of nonwoven materials, needle felts or open-pored foams.

The activation solution according to the present invention is suitable everywhere where greater importance is attached to a simple and quick preparation of the solution, including with regard to easier waste water disposal, in the activation of substrate surfaces for the purpose of subsequent chemical metallization than to a particularly stable, i.e. stabilized complex palladium/tin activation solution.

The activation solution according to the present invention is consequently suitable in particular for the activation of plastic surfaces such as those attributable to the processing of fibers of nonwoven materials or needle felts. It can also be used excellently for the activation of plastic surfaces of porous foams.

Above all, polyethylene, polypropylene, polyamide, polyester or aramide are possible as plastics material for the phases of the substrate surfaces. If the activation solution is used in the case of nonwoven materials or needle felts with a thickness between 1 and 10 mm, it is important that the fiber surface can be wetted with an aqueous solution.

Other objects, advantages and novel features of the present invention will become apparent from the following detailed description of the invention when considered in conjunction with the accompanying drawings.

DETAILED DESCRIPTION OF AN EXAMPLE

The invention is explained in still further detail below by means of an example:

An activation solution was prepared from a salt acid palladium chloride solution (about 0.12 g/l), about 80 ml of concentrated hydrochloric acid (about 37%)/l, for the remainder water, to which about 0.32 g of tin chloride /l in solid form was added while stirring. Once the tin chloride had dissolved completely, the solution was left to stand for about 10 minutes to mature. Subsequently, a needle felt web of polyethylene with a porosity of about 92%, a thickness of about 3.5 mm and a fiber thickness of about 2.7 dtex was immediately impregnated with this activation solution. Following impregnating of the web, the activation solution used was washed out from the pores of the needle felt web and then the activated needle felt web was chemically nickel-plated. After the chemical metallization, all the fibers on the surface of the needle felt web were coated with a nickel layer.

The advantages of the activation solution according to the invention are summed up once more as follows:

The activation solution can be prepared in a very simple way; the solution of the tin(II) salt is merely added to the prepared salt-acid palladium salt solution in the desired concentration while stirring, the only requirement calling for attention being the adjustment of a molar ratio of palladium/tin between about 1:1 and 1:2. After 10 minutes, the activation solution thusly prepared is mature and can be employed with satisfactory success for the activation of substrate surfaces.

A further advantage is that the activation solution according to the invention is sufficiently stable for the intended application, but precipitates of its own accord soon after use, As a result of which a large part of the pollutants contained in the solution can be conveniently separated out. In the disposal of the remaining solution, only traces of palladium and tin as well as the acid content of the solution then have to be taken into consideration. No added stabilizers, other auxiliary materials or a great excess of difficult-to-filter tin oxide or hydroxide precipitates have to be removed from the solution.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An activation solution for activating in one step an electrically nonconductive substrate surface made of a plastic material for subsequent chemical metallization of the activated substrate surface, the activation solution containing an acid, a palladium(II) compound and a tin(II) compound, the palladium being present predominantly in complexly dissolved form, wherein a molar ratio of the palladium and the tin is employed of about 1:1.5, the solution is prepared at room temperature, no further stabilizing agents or auxiliary materials are added to the solution, and the solution being mature and catalytically effective about 10 minutes after the tin(II) salt has been added to the acid palladium salt solution.

2. A method of preparing a one step activation solution for an electrically nonconductive substrate surface made of a plastic material for the purpose of a subsequent metallization of the activated substrate surface, the activating solution containing an acid, a palladium(II) compound and a tin(II) compound, and the palladium being present predominantly in complexly dissolved form, the method comprising the steps of:

first preparing a solution, which contains the palladium compound and the tin compound in a molar ratio of about 1:1.5, at room temperature;

and then completing maturation of the solution after a time of about 10 minutes, without stabilizing agents or other auxiliary materials being added to the solution.

3. A method of using an activation solution for activating in one step an electrically nonconductive substrate surface for subsequent chemical metallization of the activated substrate surface, the activation solution containing an acid, a palladium(II) compound and a tin(II) compound, the palladium being present predominantly in complexly dissolved form, wherein a molar ratio of the palladium and the tin is employed of about 1:1.5, the solution is prepared at room temperature, no further stabilizing agents or auxiliary materials are added to the solution, and the solution being mature and catalytically effective about 10 minutes after the tin(II) salt has been added to the acid palladium salt solution, the method comprising the step of:

employing the solution to activate one of a needle felt and a nonwoven material having a substrate surface made of plastic.

4. A method of using an activation solution for activating in one step an electrically nonconductive substrate surface for subsequent chemical metallization of the activated substrate surface, the activation solution containing an acid, a palladium(II) compound and a tin(II) compound, the palladium being present predominantly in complexly dissolved form, wherein a molar ratio of the palladium and the tin is employed of about 1:1.5, the solution is prepared at room temperature, and no further stabilizing agents or auxiliary materials are added to the solution, the solution being mature and catalytically effective about 10 minutes after the tin(II) salt has been added to the acid palladium salt solution, the method comprising the step of:

employing the solution to activate open-pored foams having a pore surface made of plastic.

* * * * *